US005799844A

United States Patent [19]

James

[11] Patent Number: 5,799,844

[45] Date of Patent: Sep. 1, 1998

[54] SOCK APPLYING AIDS

[75] Inventor: Gavin Hugh James, Herefordshire, United Kingdom

[73] Assignee: The Helping Hand Company (Ledbury) Limited, Ledbury, United Kingdom

[21] Appl. No.: 921,593

[22] Filed: Sep. 2, 1997

[30] Foreign Application Priority Data

Aug. 31, 1996 [GB] United Kingdom ..... 9618532

[51] Int. Cl.[6] ..... A47G 25/90

[52] U.S. Cl. ..... 223/112; 223/111

[58] Field of Search ..... 233/111, 112

[56] References Cited

U.S. PATENT DOCUMENTS

| | | | |
|---|---|---|---|
| 3,401,856 | 9/1968 | Berlin | 223/111 |
| 3,752,374 | 8/1973 | Pro | 223/111 |
| 3,853,252 | 12/1974 | Scianimanico | 223/111 |
| 4,651,909 | 3/1987 | Banting . | |
| 4,991,757 | 2/1991 | Deakyne | 223/111 |
| 5,632,424 | 5/1997 | Maier et al. | 223/112 |
| 5,673,826 | 10/1997 | Stolk | 223/112 |

FOREIGN PATENT DOCUMENTS 2010070 6/1979 United Kingdom .

*Primary Examiner*—Bibhu Mohanty
*Attorney, Agent, or Firm*—Young & Thompson

[57] ABSTRACT

A wire frame 1 has an outer covering 2 which is provided with a pulling strap 3. The wire frame 1 has a U-shaped portion 6 leading to a pair of projecting free arms 7 which lead downwardly and forwardly of the portion 6. The outer ends of the arms 7 also splay out to the sides. The material 2 forms a channel member with side walls 8. The open end portion of a sock is draped at least partly about the side walls 8. The user then places his foot in the entry to the heel end 10 and pulls the aid and sock assembly onto his foot by means of the strap 3. The sock aid will flex readily to allow it to pass around the heel of the user to position the sock around the calf of the user and the sock aid can then be pulled free.

9 Claims, 2 Drawing Sheets

SOCK APPLYING AIDS

Elderly and infirm people have difficulties in reaching down to manipulate a sock onto the foot and aids have been proposed, onto which a sock is draped and which assist the user to apply the sock to his foot by means of the aid, which is pulled from a distance by means of a strap. Some existing aids of this nature are not particularly easy to use and may require a substantial pulling effort to ensure that the sock is brought around the heel of the foot of the user.

According to the present invention there is provided a sock aid for enabling the pulling on of a sock onto a foot, and comprising a wire frame having a U-shaped central portion defining a heel part of the aid and two projecting arms whose free ends extend down and out from the U-shaped portion to form the two sides of the toe part of the aid, the frame being covered by a cloth material which defines two sides and a base between the heel and the toe, and a pulling strap secured to and extending away the heel end of the material cover.

This form of sock aid provides a good shape for gripping the sock and allowing the sock aid and the sock to be pulled around the contours of the foot of the user as effort is applied to the pulling strap. The flexibility of the wire frame allows the shape of the assembly of the sock aid and sock to change as the sock is pulled around the foot by the aid. Furthermore the arms extending from the U-shaped portion are able to flex outwardly as they come into contact with the sides of the foot and this, in addition, tends to increase the grip of the cloth material onto the sock as the aid and sock are pulled around the foot. Whilst the term "wire" is used for the frame this is intended to encompass not only a metal wire but also a preformed comparable structure moulded or pressed from a plastics material.

Ideally the cloth material will have a two-way stretch so that it will adjust readily during movement of the aid around the foot. Ideally the material will have a nap which is directed from the toe to the heel of the aid so as to provide good grip of the material of the aid onto the sock so that it is held in place as the sock is pulled onto the foot.

It in preferred that the gap between the arms should be narrower than the base of the U-shape. The U has to pass around the heel of the foot which may be somewhat larger than other parts of the foot which will be gently gripped between the two arms. The outer ends of the arms can project out sideways so as to provide added grip to the material of the sock. The base of the cloth material of the sock aid will ideally be essentially flat as it is preferable that no pocket should be formed which might snag around the heel during the pulling on operation. It may be desirable to provide a strengthening tape secured along the centre of the base of the material to reduce the tendency for the formation of such a pocket.

The pulling strap is ideally a loop attached to the cloth material, with the ends secured to either side of the centre line of the material. The preferred position of the loop ends is to secure them in the angles between the base and the sides of the cloth material.

The invention may be performed in various ways and a preferred embodiment thereof will now be described, by way of example, with reference to the accompanying drawings in which.

Figure 1:
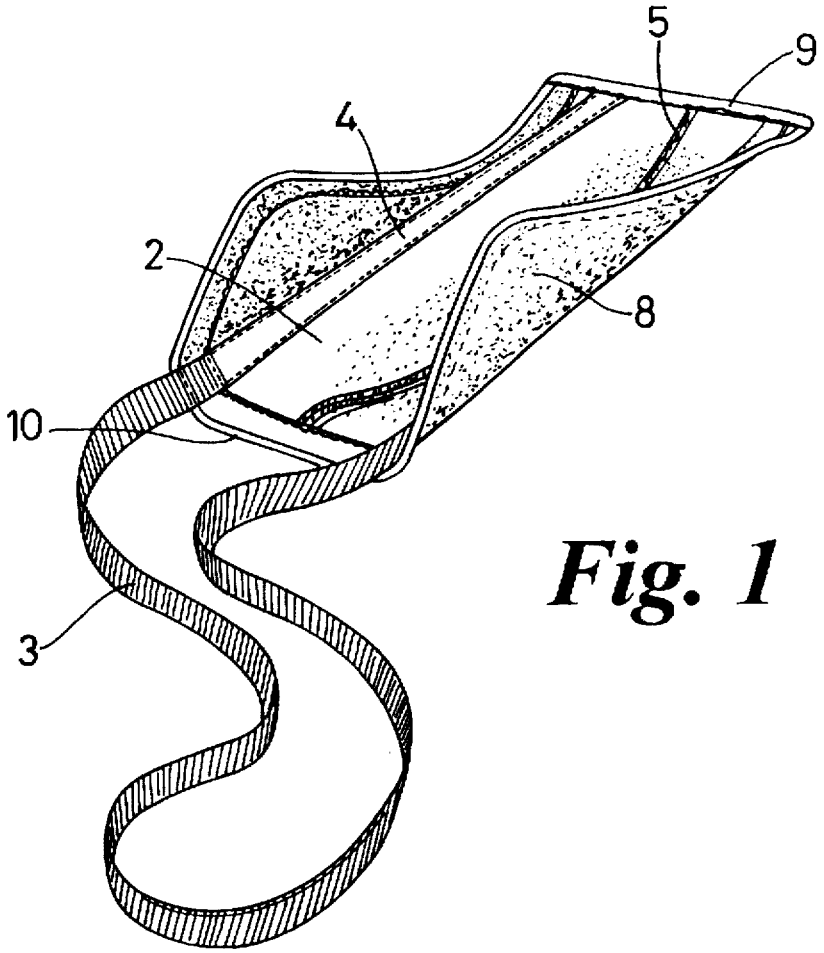
FIG. 1 is a perspective view of a sock aid of this invention.
Figure 2:
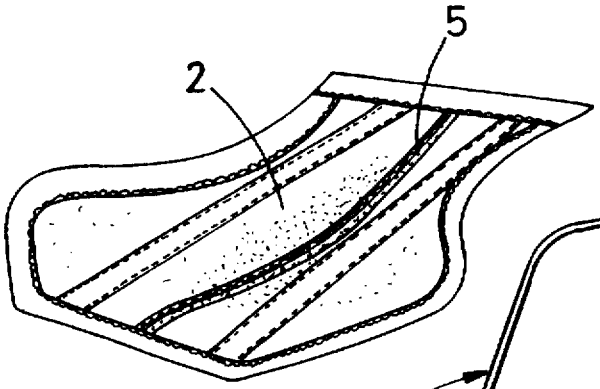
FIG. 2 is a view of a cloth covering of the aid shown in FIG. 1.
Figure 3:
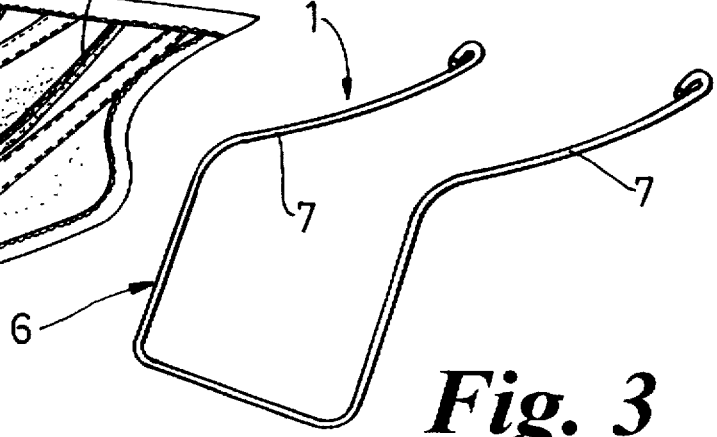
FIG. 3 illustrates the internal support wire frame of the aid shown in FIG. 1, and FIGS. 4 to 6 show stages in the process of pulling a sock onto a foot using the aid of FIG. 1.

The sock aid shown in FIGS. 1 to 3 is built around a wire frame 1 which is stitched into an outer covering 2 formed from a cloth material. A pulling strap 3 has end portions stitched into the corners of the cloth material 2 as assembled about the wire frame 1. A strengthening tape 5 in stitched along the centre of the material 2. The wire frame 1 has a U-shaped portion 6 leading to a pair of projecting arms 7 which lead downwardly and forwardly of the portion 6. The outer ends of the arms 7 also splay out to the sides. When the material 2 is assembled about the frame 1 a channel member is formed with side walls 8. The outer face of the material 2 is formed with a nap which is directed from the toe and 9 to the heel end 10 of the sock aid.

Figure 4:
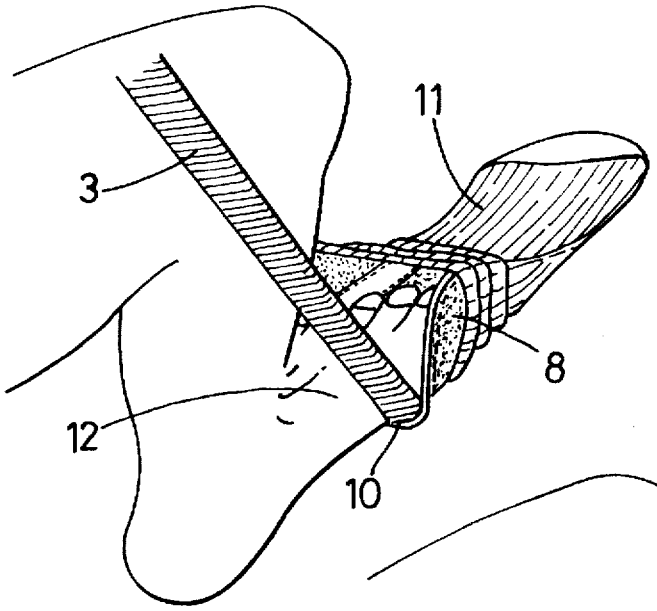
Figure 5:
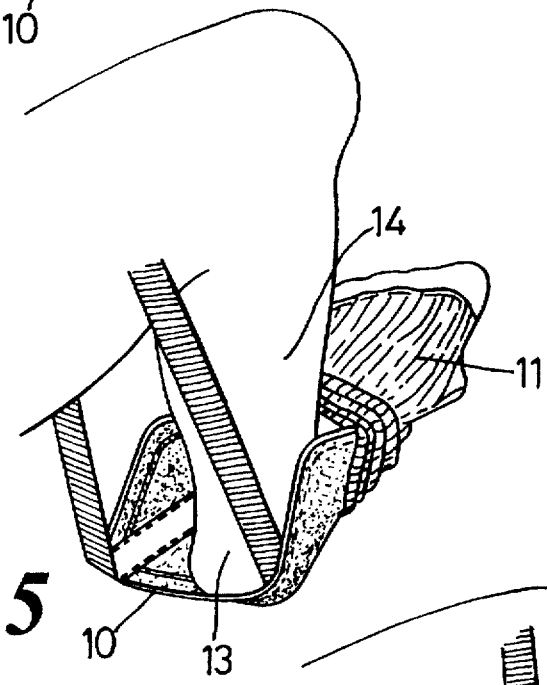
Figure 6:
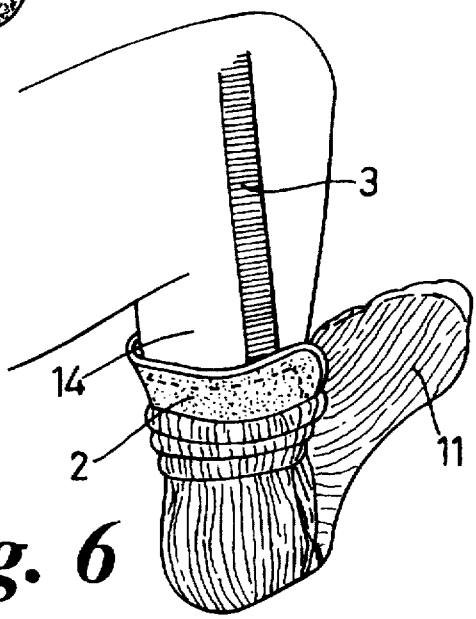

In use, as illustrated in FIGS. 4 to 6, a sock 11 is located about the sock aid so that the open end portion of the sock 11 is draped at least partly about the side walls 8. The user then places his foot 12 in the entry to the heel end 10 of the sock aid and pulls the aid and sock assembly onto his foot by means of the strap 3. Once the user's heel 13 passes beyond the heel end 10 of the sock aid the sock aid will flex readily to allow the sock aid to pass around the heel 13 of the user, thus causing the open end of the sock 11 to be positioned around the calf of the user. Ultimately the sock aid is pulled free from between the sock 11 and the calf 14 of the user and the sock will then largely be in place on the user's foot.

I claim:

1. A sock aid for enabling the pulling on of a sock onto a foot, and comprising a wire frame having a U-shaped central portion defining a heel part of the aid and two projecting arms whose free ends extend down and out from the U-shaped portion to form the two sides of the toe part of the aid, the frame being covered by a cloth material which defines two sides and a base between the heel and the toe, and a pulling strap secured to and extending away the heel end of the material cover.

2. A sock aid according to claim 1, wherein the cloth material has a two-way stretch so that it will adjust readily during movement of the aid around the foot.

3. A sock aid according to claim 1, wherein the material has a nap which is directed from the toe to the heel of the aid so as to provide good grip of the material of the aid onto the sock.

4. A sock aid according to claim 1, wherein the gap between the arms is narrower than the base of the U-shape.

5. A sock aid according to claim 1, wherein the outer ends of the arms project out sideways so as to provide added grip to the material of the sock.

6. A sock aid according to claim 1, wherein the base of the cloth material of the sock aid is essentially flat.

7. A sock aid according to claim 1, wherein a strengthening tape is secured along the centre of the base of the material.

8. A sock aid according to claim 1, wherein the pulling strap is a loop attached to the cloth material, with the ends secured to either side of the centre line of the material.

9. A sock aid according to claim 8, Wherein the loop ends are secured in the angles between the base and the sides of the cloth material.

* * * * *